United States Patent [19]

Ciferri et al.

[11] 4,167,614

[45] Sep. 11, 1979

[54] PROCESS OF PRODUCING MULTI-ORIENTED FIBRES AND FILMS OF ALIPHATIC POLYAMIDES

[76] Inventors: Alberto Ciferri, Via Mazzini, 210, Bogliasco, Italy, 16100; Domenico Acierno, Via D. Scina, 54, Palermo, Italy, 90100; Giovanni C. Alfonso, Frazione Rovereto, Gavi Ligure, Italy, 15066

[21] Appl. No.: 731,020

[22] Filed: Oct. 8, 1976

[30] Foreign Application Priority Data

Oct. 17, 1975 [IT] Italy ..... 12836 A/75

[51] Int. Cl.[2] ..... C08G 20/12

[52] U.S. Cl. ..... 525/4; 264/211; 263/235; 525/432

[58] Field of Search ..... 264/211, 235; 260/785, 260/45.7 P, 45.7 R; 526/4

[56] References Cited

U.S. PATENT DOCUMENTS

| | | | |
|---|---|---|---|
| 2,214,442 | 9/1940 | Spanagel | 264/211 |
| 3,080,345 | 3/1963 | Brooks et al. | 260/78 S |
| 3,156,750 | 11/1964 | Cuculo | 260/45.75 C |
| 3,228,898 | 1/1966 | Illing et al. | 260/45.75 |
| 3,367,926 | 2/1968 | Voeks | 260/93.7 |
| 3,548,584 | 12/1970 | Silverman et al. | 264/290 N |
| 3,551,548 | 12/1970 | Prignac et al. | 264/211 |
| 3,558,569 | 1/1971 | Koto et al. | 264/211 |
| 3,585,264 | 6/1971 | Thomas | 264/211 |
| 3,622,545 | 11/1971 | Foldi et al. | 264/290 N |
| 3,624,193 | 11/1971 | Sze | 264/290 N |
| 3,655,630 | 4/1972 | Zimmerman | 264/290 N |
| 3,716,611 | 2/1973 | Chapman | 264/290 N |
| 3,755,221 | 8/1973 | Hitch | 264/300 |
| 3,849,976 | 11/1974 | Kenyon | 264/290 N |
| 3,867,339 | 2/1975 | Sanroma | 260/78 S |
| 4,012,557 | 3/1977 | Cornelis | 264/210 F |

FOREIGN PATENT DOCUMENTS

| | | | |
|---|---|---|---|
| 50-2654 | 1/1975 | Japan | 264/211 |

*Primary Examiner*—Jay H. Woo

*Attorney, Agent, or Firm*—Wigman & Cohen

[57] ABSTRACT

Aliphatic polyamides prepared in the form of fibres or films having multioriented fibres and having a modulus of elasticity of at least 1000 kg/mm$^2$.

15 Claims, No Drawings

PROCESS OF PRODUCING MULTI-ORIENTED FIBRES AND FILMS OF ALIPHATIC POLYAMIDES

BACKGROUND OF THE INVENTION

The present invention relates to a process of producing doubly oriented fibres and films of aliphatic polyamides. The fibres and films of the present invention are characterized by the fact that they exhibit a higher tensile strength than that of the doubly oriented fibres and films of aliphatic polyamides prepared according to the conventional techniques.

It is known that the tensile strength or modulus of elasticity (M.E.) of fibres formed of linear polymers, in particular, polyamides, is considerably lower than that which could be theoretically expected, if the macromolecules would be elongated and oriented parallelely to the fibre axis. For instance, said modulus (M.E.) of a typical fibre of nylon 6, prepared according to the conventional spinning processes is of the order of 200 $kg/mm^2$, while the value which can be theoretically obtained is at least of the order of a higher magnitude. This difference can be attributed to the fact that in the conventional spinning processes the complete parallelization and elongation of the single macromolecular chains cannot be attained along the fibre axis, but, on the contrary, an only partially elongated structure is obtained oriented along the axis of the fibre. If in the process of preparation of the fibre it would be possible to elongate and orient all the macromolecules along the fibre axis, the fibre itself should attain the maximum value of the M.E. which could be theorically expected on the basis of the stresses which are necessary for the deformation of the chemical linkages formed along the macromolecular chain.

Attempts have been recently made to obtain unusual mechanical properties in the polymeric solids. According to the U.S. Pat. No. 3,671,542 of the E. I. du Pont de Nemours and Company, aromatic polyamides have been obtained, which exibit a modulus M.E. up to about 9000 $kg/mm^2$ (equivalent to about 1000 g/denier) by a wet spinning process, starting from anisotropic solutions. The possibility of preparing anisotropic solutions is however limited to polymers in which the presence of an aromatic ring assures a rigid structure of the single molecules dispersed in the solution. In the case of non-aromatic polyamides, such as those formed by polycondensation of Epsilon-caprolactam (nylon 6) and pyrrolidone (nylon 4), which cannot form anisotropic solutions, the method disclosed in the aforementioned U.S. Pat. No. 3,671,542 cannot be applied.

Another approach aiming to provide unusual mechanical properties in the polymeric solids has been disclosed in the British Patent Application No. 10746/73 in the name of G. Capaccio and I. M. Ward.

In this British patent application provision has been made to prepare a polyethylene having a modulus of elasticity which can reach the aforementioned value which has been reached by the aromatic polyamides by applying cold extrusion and by the control of the molecular weight. However, this method does not relate to polyamides.

OBJECTS AND SUMMARY OF THE INVENTION

The object of the present invention is to provide non-aromatic polyamides having unusual mechanical properties and which are obtained by a process quite different from the aforementioned processes. Broadly, the method of the present invention comprises the steps of adding to the non-aromatic polyamides at least one inorganic salt of the class of the halides of alkaline or alkaline-earth metals, multidirectionally orienting the obtained material at a prevalently amorphous state and developing of the crystallinity obtained by a prolonged heating at a temperature of the said polyamides, while maintaining the material under the acquired draft or tension condition.

The addition of the inorganic salt to the polyamide can be performed either by a direct mixing of the already formed polyamide with the salt (occasionally in presence of a co-solvent), or by polymerization of the monomer in presence of the salt. It is important to point out that the conditions for the formation of the polyamide-salt mixtures and some characteristics of said mixtures have been already described in other preceding patents. In the Italian Pat. No. 943.553 to A. Ciferri a process has been described for directly mixing already polymerized polyamides with inorganic salts, while in the Italian Patent Application No. 12460-A/74 (Inventors: S. Russo, G. Bonta, A. Ciferri, E. Bianchi, B. Valenti) there has been described, in a very detailed manner, a polyamide polymerization in the presence of inorganic salts. As can be well understood from said aforementioned Italian patents, some properties of the polyamide-salt mixture are different from the corresponding properties of the pure polyamides. In particular, the presence of the salt decreases either the melting temperature or the crystallinity of the pure polyamide. Thus owing to the presence of the salt, the polyamides can be worked (by spinning, extrusion, etc.) at temperatures lower than the temperatures conventionally used for the polyamides, also reducing either the energy consumptions or the difficulties due to the phenomenon of the thermal degradation which takes place at the high working temperatures which are conventionally used. From the same latest Italian patents it can also be learned that if the polyamide, which is treated in presence of salt is subsequently subjected to water washings (or to a prolonged new heating in some cases) there is a complete recovery of the properties of the pure polyamides, in particular, of the melting temperature and crystallinity.

As far as the recovery of the mechanical properties of the pure polyamides are concerned, as a result of the salt washing (or prolonged heating in some cases) said two Italian patents do not give sufficient details, since they only state that such mechanical properties can be restored (in some cases, cited in the Examples, there is a modest improvement in the properties of the pure polyamides as a result of washing of the salt). It is to be pointed out that the character of mechanical properties, to which reference has been made in said patents, is that which has been exhibited by samples of non-oriented polyamides (isotropic films) or only lightly oriented (extruded fibres in absence of tensile stress).

Subsequent studies have now permitted us to discover that by using an orientation process on the polyamide-salt mixtures, followed by a prolonged heating while maintaining the material under the acquired draft condition, we can obtain highly oriented fibres or films having mechanical properties much higher than those of the polyamides which have not been treated with salts.

As will be better explained in the examples which follow, an orientation can be imparted to the polyamide-salt mixture in various manners. For instance, a mechanically prepared polyamide-salt mixture can be extruded in absence of solvent at a temperature higher than the melting temperature of said mixture (much lower than that of the pure polyamide) and the fibre can be drawn in a spinning line, controlling the fibre cooling. Or a solution of pure polyamide and salt can be spun in a co-solvent, coagulating the fibre into a liquid which must be a solvent for the salt, but which does not dissolve the polyamide and which contains salt having the same activity as the gel. In this case the salt remains in the coagulated fibre and the orientation will be controlled, varying the tensile stress on the spinning line and the other parameters of the working process. Or a doubly oriented film can be prepared, starting from an isotropic film of the polyamide-salt mixture, subjecting it to consecutive drafts along two perpendicular directions, using a machine of the "Instron" type as well as suitable temperature.

In all these cases the working is managed in such a manner to reduce the crystallinity of the polyamide owing to the presence of the salt (in comparison with the crystallinity of the pure polyamide), thus enabling a more efficient orientation and elongation of the molecular chains to be had, which, owing to the fact that they are situated in the non-crystalline zones, are more easily deformable and orientable. The subsequent prolonged heating or also a salt washing step is carried out in such a way so as not to eliminate such orientation, but, on the contrary, so as to develop the crystallinity in the oriented state, thus producing a highly oriented and crystalline polyamide having surprising mechanical properties.

Particularly advantageous results have been obtained, using nylon 6 and nylon 4 including salts, such as lithium halides and calcium chloride. The following Examples have been given for the purpose of better understanding, without limiting the invention, the essential aspects of the present invention. In such Examples the possibility of producing doubly oriented fibres and films of polyamides having mechanical properties well higher than those of the conventionally treated polyamides has been well illustrated.

The fields of application of said materials are numerous since the polyamides attain mechanical properties similar to those of metallic materials, while still exibiting a density which is twice or three times lower than that of the metallic materials.

DESCRIPTION OF PREFERRED EMBODIMENTS

Having described the invention in general terms, the following Examples are set forth to more particularly illustrate the present invention. Such Examples are not, however, meant to be limiting.

EXAMPLE 1

A sample of pure nylon 6 having a melting temperature of 235° C. containing 4% (by weight) of LiCl is prepared by means of homogenizing the two finely subdivided components in a tube under vacuum at a temperature of 250° C. for 5 hours. The melting point of the mixture is 187° C.

A sample of pure nylon 6 and a nylon 6-LiCl mixture are used for the preparation of fibres by means of a conventional extruder under pressure maintained at 260° C. The extrusion takes place in air at ambient temperature and the fibre is collected by a revolving cylinder so as to obtain a draft ratio of about 5%. The fibres are then dried for at least two days and thence they are subjected to resistance test to the tensile stress in an Instron machine. The value of the modulus of elasticity, for either of the fibres obtained from pure nylon 6 or from the mixture with LiCl is of about 220÷240 kg/mm$^2$. The measure of the crystallinity degree in a differential calorimeter indicates a value of about 40% in the case of the pure nylon 6 and of about 5% in the case of the Nylon 6-LiCl mixture. The fibres are then maintained at a constant length in a stove for 17 days where they are dried. The value of the M.E. in the case of pure nylon 6 (and its crystallinity) remains unvaried, while the M.E. value of the fibres which are obtained starting from the nylon 6-LiCl mixture is increased up to about 1000 kg/mm$^2$ and the crystallinity is increased up to about 40%.

EXAMPLE 2

A nylon 6-LiCl mixture is prepared, as described in the Example 1; also the fibre extrusion has been carried out as described in the Example 1. The obtained fibres, having a draft ratio 5:1, shown also a M.E. of about 230 kg/mm$^2$ (before that the crystallinity is developed by a new heating at 160° C.). At this moment the fibres have been furtherly drawn with the Instron machine into a thermostatic room maintained over the temperature of vitreous transition (about 60° C.). The so imparted draft ratio is of about 3:1. The crystallinity is now developed by heating at 160° C. for 17 days in the condition stated in the Example 1. The so obtained M.E. values are of about 5000 kg/mm$^2$.

EXAMPLE 3

A sample of anhydrous pyrrolidone is mixed with 8% LiCl and with metallic sodium to obtain a 0.4 molar sodium-pyrrolidone mixture (catalyst). 600–700 ml of dehydrated $CO_2$ are then added. The polymerization takes place rapidly at about 50° C.

A nylon 4-LiCl mixture is then spinned at 210° C., as described in the Example 1, and the fibres oriented at 80° C. in the Instron machine so as to obtain a total draft ratio of 20:1. The development takes place, as provided in the Example 1. The corresponding M.E. is of about 3000 kg/mm$^2$.

EXAMPLE 4

A nylon 6-5% $CaCl_2$ mixture was prepared in the form of a film of about 2 mm by means of a compression into a mold under a pressure of 150 kg/cm$^2$ for 40 seconds at 200° C. The film has been subjected to following operations of draft along two perpendicolar directions set at right angles to each other, at 80° C. in an Instron machine. The draft ratios in the two directions were of about 3:1. When the crystallinity was developed by extraction of the salt with boiling $H_2O$, the M.E. in the two directions was of about 1000 kg/mm$^2$.

EXAMPLE 5

A homogenous solution of nylon 6 40% (by weight) in formic acid was mixed with LiBr so as to obtain a salt/nylon 6 ratio of 6% by weight. This homogenous solution was spun at ambient temperature through a nozzle of a diameter of 75 μm at the linear speed of about 50 m/min in water containing 6% LiBr. The fibre was collected from the coagulation bath at a speed of about 20 m/min. After the coagulation process the fibre was passed through pure water, applying a draft ratio of 1.26:1 and then drawn again with a draft ratio of about 5.2:1.

The so prepared fibre was conditioned in a stove under vacuum at 25° C. for 3 days and then it is caused to crystalline at a constant length still in a stove under vacuum at 160° C. for 17 days. The M.E. values exhibited by the so prepared fibres are about 1500 kg/mm$^2$.

What we claim is:

1. A process for increasing the modulus of elasticity of aliphatic polyamide fiber and film, comprising the steps:

a. forming an aliphatic polyamide-inorganic salt mixture, said inorganic salt being taken from the class consisting of alkaline metal salt and alkaline earth metal salt, said inorganic salt being present in an amount effective to reduce the melting temperature or crystallinity of the aliphatic polyamide;

b. mechanically orienting the aliphatic polyamide-salt mixture while in substantially an amorphous state; and c. developing the crystallinity of the oriented aliphatic polyamide-salt mixture by heating, while under tension, at a temperature of at least 50° C. below the melting point of the polymer and for a time which is effective for increasing the modulus of elasticity to at least about 1000 kg/mm$^2$.

2. A process according to claim 1 wherein said polyamides are taken from the group consisting of nylon 4, nylon 6 and nylon 66.

3. A process according to claim 1 wherein said inorganic salts are present in an amount ranging from 1% to 8% by weight of the polymer.

4. A process according to claim 1, wherein said inorganic salts are halides.

5. A process according to claim 4 wherein said inorganic salt is lithium chloride or lithium bromide.

6. A process according to claim 4 wherein said inorganic salt is calcium chloride.

7. A process according to claim 4 wherein said heating step is prolonged, e.g., 17 days.

8. A process according to claim 4 wherein said inorganic salt is extracted from the polyamide to develop the crystallinity thereof.

9. Oriented fibers of aliphatic polyamide made in accordance with the process of claim 1.

10. Oriented films of aliphatic polyamide made in accordance with the proces of claim 1.

11. A process according to claim 1 further including the step of forming a biaxial film by subjecting the developed crystalline oriented aliphatic polyamide-salt mixture film to consecutive drafts along two perpendicular directions.

12. The process according to claim 1 wherein said formed aliphatic polyamide-inorganic salt mixture is heated to above the melting point of said polyamide to form a molten fluid prior to mechanically orienting said aliphatic polyamide-salt mixture.

13. The process according to claim 1 wherein said aliphatic polyamide-inorganic salt mixture is formed as a solution prior to mechanically orienting said aliphatic polyamide-salt mixture.

14. The process according to claim 1 wherein the step of mechanically orienting the aliphatic polyamide-salt mixture is done by extrusion and said further step of developing the crystallinity is carried out at an elevated temperature for a prolonged period of time.

15. A process for preparing aliphatic polyamide having a modulus of elasticity of at least about 1,000 kg/mm$^2$, comprising the steps of initially suppressing the crystalline structure of said aliphatic polyamide by the introduction of an effective crystalline retarding agent to said polyamide and thereafter developing the crystallinity of said polyamide by heating while maintaining the polyamide in tension for a period of time which is effective to sufficiently orient the crystalline structure formed and to yield a modulus of elasticity of at least about 1,000 kg/mm$^2$.

* * * * *

UNITED STATES PATENT AND TRADEMARK OFFICE

CERTIFICATE OF CORRECTION

PATENT NO. : 4,167,614

DATED : September 11, 1979

INVENTOR(S) : Alberto CIFERRI, Domenico ACIERNO, Giovanni C. ALFONSO.

It is certified that error appears in the above-identified patent and that said Letters Patent are hereby corrected as shown below:

TITLE PAGE

Beneath the inventors, please add the following:

--Assignee: Consiglio Nazionale Delle Ricerche
Milano, Italy--

Signed and Sealed this

*Eleventh* Day of *December 1979*

[SEAL]

*Attest:*

SIDNEY A. DIAMOND

*Attesting Officer*

*Commissioner of Patents and Trademarks*